US005282610A

United States Patent [19]

Turner et al.

[11] Patent Number: 5,282,610

[45] Date of Patent: Feb. 1, 1994

[54] SELF-INDEXING VISE

[75] Inventors: Mark A. Turner, Arlington; Laszlo Ferenczi, Irving, both of Tex.

[73] Assignee: Vought Aircraft Company, Dallas, Tex.

[21] Appl. No.: 13,010

[22] Filed: Feb. 3, 1993

[51] Int. Cl.[5] ..... B25B 1/24

[52] U.S. Cl. ..... 269/258; 269/269

[58] Field of Search ..... 269/258-265, 269/268, 269, 270, 75; 279/123; 81/424; 248/181

[56] References Cited

U.S. PATENT DOCUMENTS

| | | | |
|---|---|---|---|
| 109,121 | 11/1870 | Findlay . | |
| 357,524 | 2/1887 | Denney . | |
| 699,585 | 5/1902 | Snediker . | |
| 1,105,193 | 7/1914 | Gerion . | |
| 1,844,616 | 2/1932 | Whiton . | |
| 2,194,568 | 3/1940 | Romaine et al. . | |
| 2,392,310 | 1/1946 | Chrestoff . | |
| 2,556,206 | 6/1951 | Militano | 248/181 |
| 2,754,591 | 7/1956 | Schweizer | 269/269 |
| 2,993,395 | 7/1961 | Bohn | 269/75 |
| 3,050,301 | 8/1962 | Palazzolo . | |
| 3,998,445 | 12/1976 | Goltz . | |
| 4,743,003 | 5/1988 | Dietlein . | |
| 5,022,291 | 6/1991 | McBain | 81/424 |

*Primary Examiner*—Robert C. Watson

*Attorney, Agent, or Firm*—Arnold, White & Durkee

[57] ABSTRACT

A self-indexing vise 10 for clamping an angled workpiece 47 includes a pair of jaws 20, 32 capable of relative movement, a semi-cylindrical jaw insert 54 received in a recess 52 in one of the jaws 20, 32 and capable of pivoting to automatically conform to the contour of an angled workpiece 47. The jaw insert 54 is sized slightly larger than the recess 52 in which it pivots such that when the vise 10 is loaded, a press fit forms between recess 52 and jaw insert 54 which locks the insert 54 into position.

7 Claims, 3 Drawing Sheets

SELF-INDEXING VISE

BACKGROUND OF THE INVENTION

1. Field of the Invention

This invention relates generally to a vise for clamping a workpiece and more particularly to a vise capable of clamping a workpiece having an angularly disposed member wherein the angled portion of the workpiece is clamped between a curvilinear surface and a pivotable surface.

2. Description of the Related Art

There are a variety of clamping devices available in the art for clamping a workpiece during machining or other manufacturing operations. Most of these devices secure the workpiece by clamping it between two or more jaws which are capable of movement relative to one another. The jaws may have fixed or moveable bearing surfaces which contact the workpiece. Where moveable bearing surfaces are utilized, they are typically designed to pivot in some fashion to conform to irregularly shaped workpieces.

Angled extrusions, such as those frequently seen in aircraft structural parts, present a particularly difficult clamping task to the machinist. If the base of an angled extrusion is to be machined, the angled portion of the extrusion must be clamped. For accurate machining, the base of the angled extrusion must remain parallel to and flush with the sacrificial material that is typically inserted between the vise jaws and the angled extrusion base. Ordinary vises tend to impart clamping forces at different locations on the angled portion of the angled extrusion, thereby creating a net moment which will tend to move some portion of the base out of parallel with the sacrificial material. Angled extrusions also typically require the machinist to manually adjust the vise jaws to approximately conform to the angle of the angled portion of the extrusion. This is a tedious time consuming process which, depending upon the size of the workpiece and vises involved, may involve a blind operation since the machinist may not be able to visually verify that the jaws have closely matched the angle of the extrusion. Even if the operator carefully manually positions the vise jaws to secure the angled extrusion in a vise which has pivoting bearing surfaces, the pivoting bearing surfaces may have a tendency to rotate during machining which will cause misalignment of the workpiece.

SUMMARY OF THE INVENTION

The present invention includes a new device for quickly and accurately clamping a workpiece, such as, for example, an angled extrusion. The invention is adapted to rapidly engage and automatically adjust to workpieces of various angularities without the need for lengthy manual adjustments. In a preferred embodiment, the invention includes a fixed jaw which has an external radius for contacting one surface of the workpiece, a second moveable jaw which is capable of movement relative to the fixed jaw, and which has a generally cylindrical recess, and a semi-cylindrical jaw insert which is pivotally mounted in the recess in the moveable jaw. The jaw insert may be mounted to freely pivot in the recess or it may be spring biased so that it returns to a set position when a workpiece is removed. The radius of the cylindrical portion of the jaw insert should be greater than the external radius on the fixed jaw to minimize the moment induced when severely angled workpieces are clampled. The radius of the cylindrical portion of the jaw insert should be slightly larger than the radius of the cylindrical recess in the moveable jaw such that when the jaw insert engages a workpiece under load, the cylindrical surface of the jaw insert will form a press fit with the cylindrical recess on the movable jaw, thereby locking the jaw insert, and thus the workpiece, into position.

DESCRIPTION OF THE PREFERRED EMBODIMENTS

Figure 1:
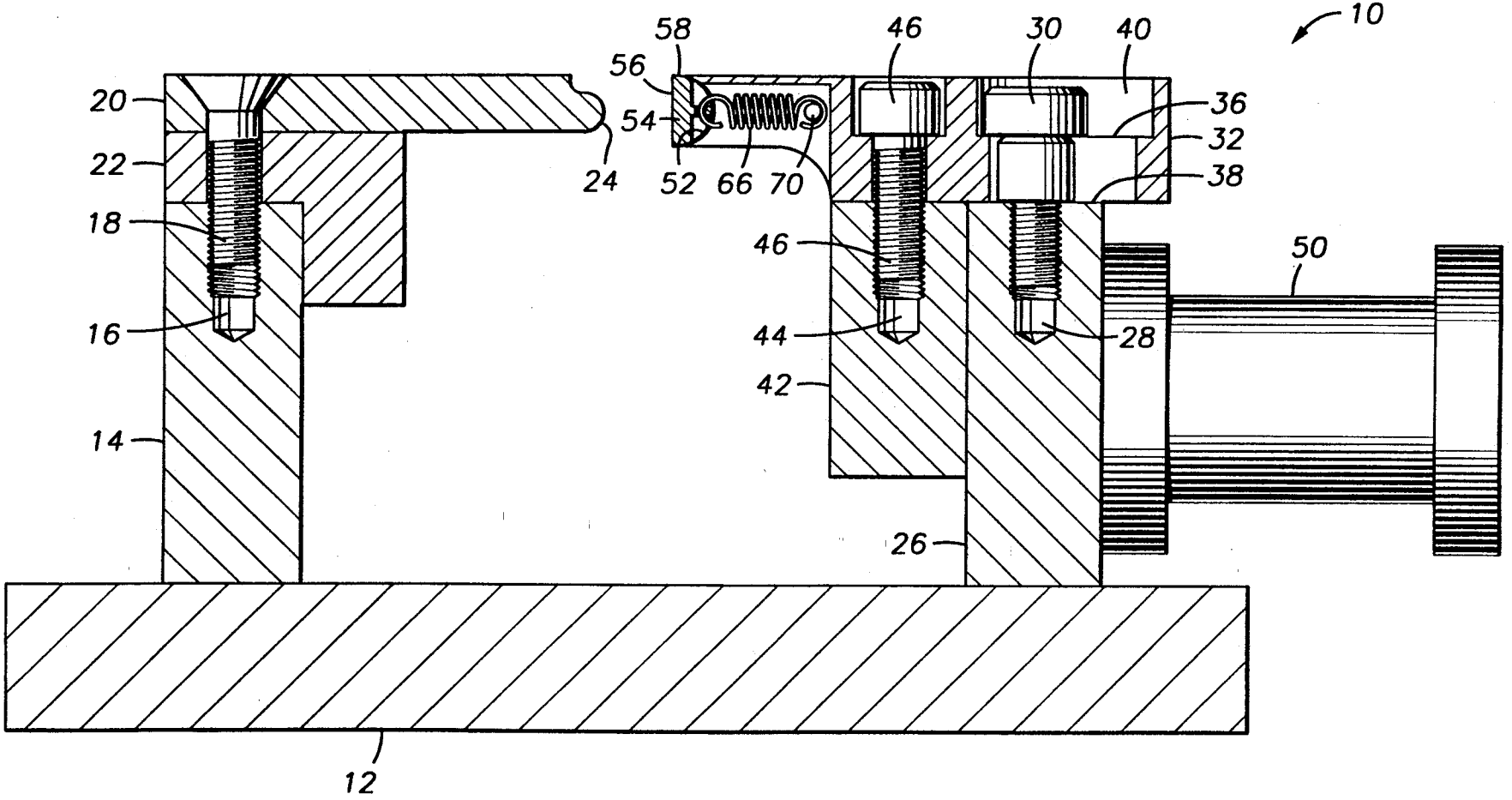
FIG. 1 depicts the self-indexing vise, illustrated in section.

Referring to FIG. 1, self-indexing vise 10 includes a substantially rectangular base 12 which is generally configured to set on top of a machine tool. Base 12 may be of variable geometry depending upon the particular router or mill or other machine tool upon which it is placed.

A fixed jaw post 14 extends up from and is coupled to base 12. Post 14 includes bore 16 adapted to receive bolt 18.

Fixed jaw 20 rests upon spacer 22 which is placed between fixed jaw 20 and post 14. Spacer 22 is sized and designed to place fixed jaw 20 a certain height above base 12 and may be obviated depending upon the thickness of fixed jaw 20. Fixed jaw 20 and spacer 22 are fixed to post 14 by bolt 18. The number and spacing of bolts 18 will depend on the length of vise 10.

Fixed jaw 20 has at one terminus a full external radius 24. In FIG. 1, external radius 24 is shown sized smaller than the thickness of fixed jaw 20. However, the dimension of external radius may coincide with the thickness of fixed jaw 20, depending upon the thickness of fixed jaw 20.

A moving jaw post 26 is fixedly attached to and emanates up from base 12. Post 26 includes a bore 28 which is adapted to receive bolt 30. Moveable jaw 32 slidably rests on moveable jaw post 26. Alignment of moveable jaw 32 when moveable jaw 32 is translated, it is partially maintained by bolt 30 which is preferably a shoulder bolt. Moveable jaw 32 is prevented from upward translation during horizontal translation by bolt 30 which bears upon shoulders 36 and 38 of counterbore 40. Moveable jaw 32 is also fixedly attached to piston block 42. Piston block 42 includes a bore 44 adapted to receive bolt 46 which fixes moveable jaw 32 to piston block 42. The number and spacing of bolts 30, 46 will depend on the length of vise 10. Moveable jaw 32 may be alternatively fixed to piston block 42 by other fastening methods such as welding or riveting, etc.

Figure 2:
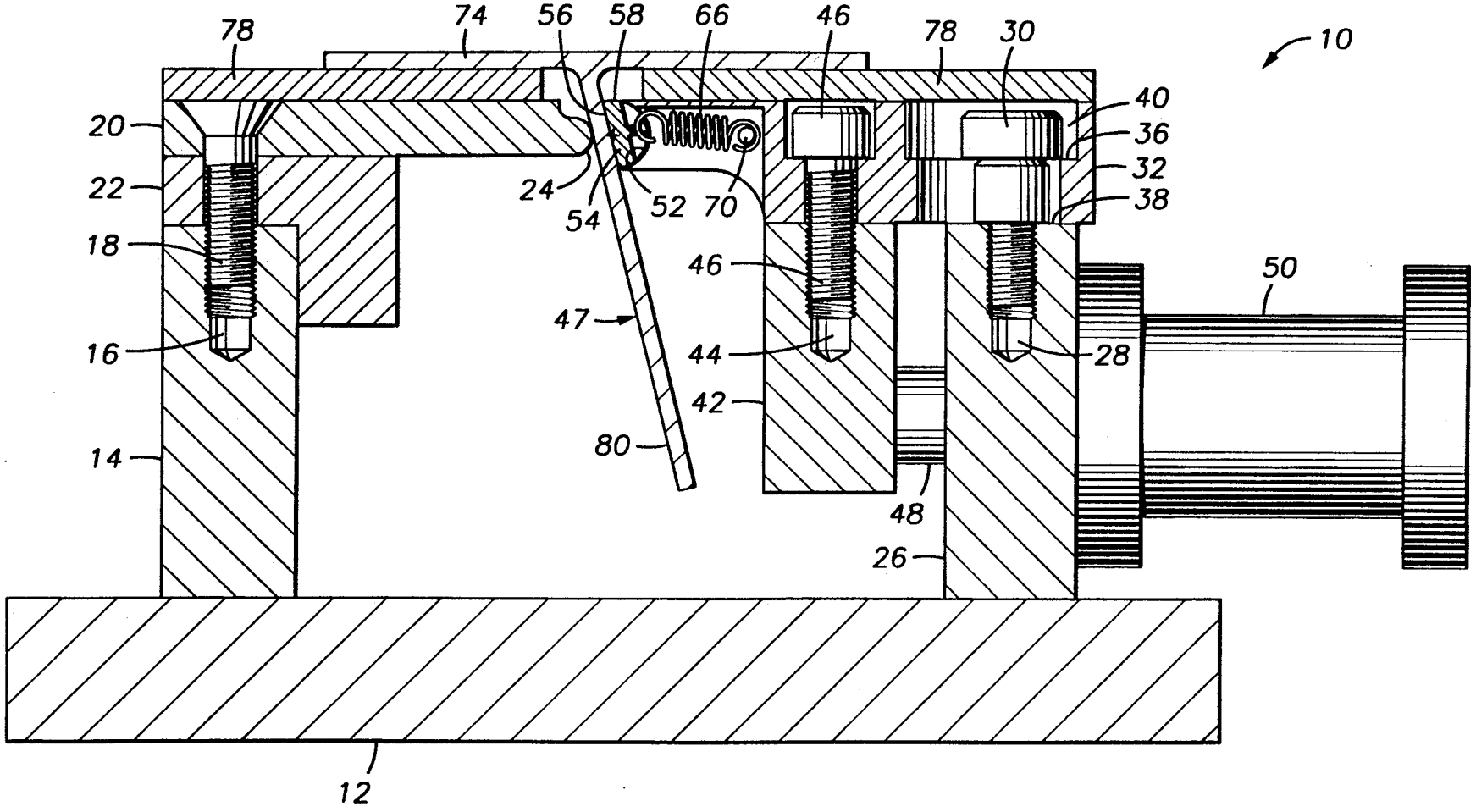
FIG. 2 depicts the self-indexing vise, illustrated in section with an angled workpiece in position.

Referring now also to FIG. 2 which shows vise 10 engaging a workpiece 47, moveable jaw 32 is translated horizontally by piston rod 48 which is attached to piston block 42 and cylinder 50. Cylinder 50 may be either hydraulically or pneumatically operated, or alternatively actuated by some other mechanical mechanism such as a rack and pinion gear system.

Moveable jaw 32 also includes a recess 52 which is positioned in opposition to the external radius 24 on fixed jaw 20. Recess 52 extends longitudinally along the entire length of moveable jaw 32. Recess is adapted to pivotally receive pivoting member 54.

Figure 3:
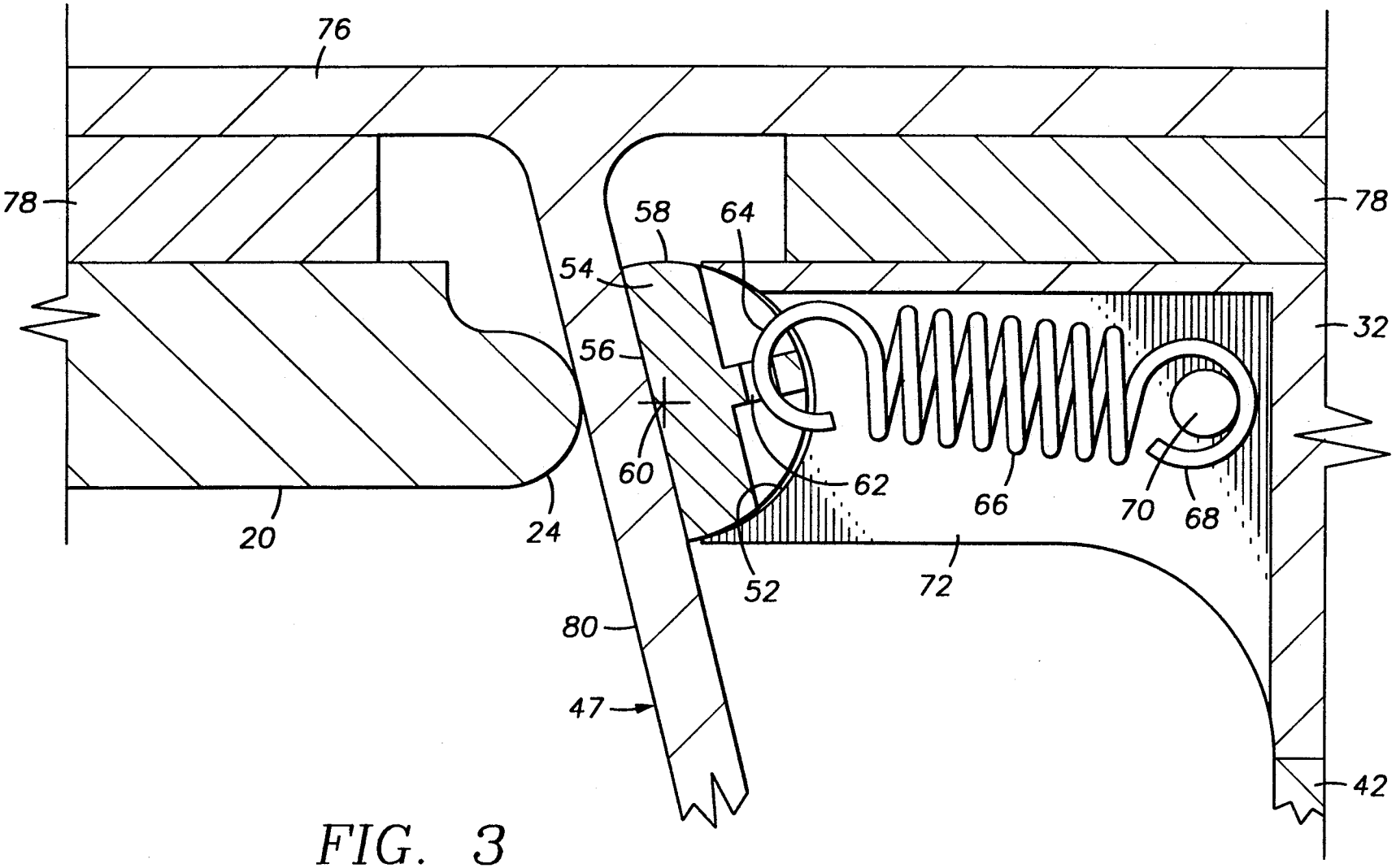
FIG. 3 depicts a magnified view of the contacting portion of the self-indexing vise, illustrated in section.

Referring now also to FIG. 3, pivoting member 54 includes a substantially flat bearing surface 56 and a semi-cylindrical surface 58. Pivoting member 54 should be fabricated such that the center 60 of semi-cylindrical surface 58 of pivoting member 54 lies as close as possible to bearing surface 56. This will reduce the distance between the point where workpiece 47 contacts the external radius 24 of fixed jaw 20 and the center 60 of semi-cylindrical surface 58, and thereby reduce the moment induced by the force imparted by moveable jaw 32 and the opposing force exerted by fixed jaw 20. Pivoting member 54 should also be fabricated such that the radius of semi-cylindrical surface 58 is slightly larger than the radius of recess 52 in moveable jaw 32. The difference in radii will facilitate the locking feature to be discussed more fully below.

Pivoting member 54 also includes a passage 62 which is adapted to receive one anchor 64 of a spring 66. The second anchor 68 of spring 66 is connected to a pin 70 which protrudes from web 72 in moveable jaw 32. Spring 66 is adapted to bias pivoting member 54 such that the bearing surface 56 of pivoting member 54 returns to a nearly vertical position when pivoting member 54 is not in physical contact with workpiece 47. The number of springs 66 and thus the number of passages 62, pins 70 and webs 72 may be varied dependent upon the length of the vise 10.

Referring to FIGS. 2 and 3, vise 10 operates in the following manner. Workpiece 47 is placed in vise 10 such that the base 76 of workpiece 47 is placed on top of sacrificial material 78 and the angled portion 80 is sandwiched between fixed jaw 20 and moveable jaw 32. Moveable jaw 32 is then translated horizontally by piston rod 48 until the angled portion 80 of workpiece 47 is firmly clamped between external radius 24 and bearing surface 56. As bearing surface 56 begins to contact the angled portion 80, it pivots to automatically conform to the angle of the workpiece 47. When sufficient clamping force has been exerted by piston 48, a press fit is formed between the semi-cylindrical surface 58 of pivoting member 54 and the recess 52 in moveable jaw 32, thereby locking pivoting member 54 into position. This locking feature restricts the workpiece 47 from either rotating or translating upward which would cause misalignment during machining. This locking feature is facilitated by the differential radii of the semi-cylindrical surface 58 and the recess 52.

While the semi-cylindrical surface 58 and the recess 52 may be fabricated with the same radius, it is preferred that the radius of semi-cylindrical surface 58 exceed that of recess 52. The required differential between the radii of the semi-cylindrical surface 58 and the recess 52 may increase depending upon the sizes of the semi-cylindrical surface 58 and the recess 52. For example, experiment has shown that when the radius of the recess 52 is approximately ½ inch (approximately 0.001 m), the radius of the semi-cylindrical surface 58 should exceed the radius of the recess 52 by approximately 0.007 to 0.010 inches (approximately 0.0002 m to 0.0003 m). However, for larger sized embodiments of the present invention, the required radius differential may increase. For example, if the radius of the recess 52 is approximately 1 inch (approximately 0.03 m), the radius of the semi-cylindrical surface should exceed the radius of recess 52 by approximately 0.0014 to 0.02 inch (approximately 0.0004 m to 0.0005 m).

Experiment has also shown that when the radius of semi-cylindrical surface 58 and the recess 52 are approximately ½ inch (approximately 0.001 m), piston 48 should exert a force of approximately 200 pounds per linear inch (approximately 35,000N/m) of pivoting member 54 length in order to sufficiently lock semi-cylindrical surface 58 in recess 52.

It is also preferred that the radius of external radius 24 be smaller than the radius of the semi-cylindrical surface 58. This will assist in reducing the distance between the point on the external radius 24 that contacts the angled portion 80 of workpiece 47 and the point on the bearing surface 56 through which the clamping force of moveable jaw 32 acts, thereby reducing the moment that is induced by the clamping force and the resisting force imparted by the external radius 24. External radius 24 is preferably fabricated with a radius that is as small as possible, yet not so small, that contact between the angled portion 80 of workpiece 47 and external radius 24 will mar the surface of the angled portion 80 of workpiece 47, or cause external radius 24 to fail.

Once the workpiece 47 has been locked into position, machining can proceed. When machining is concluded the piston 48 is retracted and the moveable jaw 32 translated horizontally away from the workpiece 47. The pivoting member 54 biases back to its original position and the workpiece 47 may be removed.

The moveable jaw 32, including the external radius 24, the pivoting member 54, and the recess 52, and the fixed jaw 20 including the external radius 24, are preferably manufactured from 4140, 4142 or similar steel.

Many modifications and variations may be made in the techniques and structures described and illustrated herein without departing from the spirit and scope of the present invention. For example, both fixed jaw 20 and moveable jaw 32 may be capable of movement. Accordingly, the techniques and structures described and illustrated herein should be understood to be illustrative only and not limiting upon the scope of the present invention.

What is claimed is:

1. A vise, comprising:

a first jaw having a partially cylindrical bearing surface;

a second jaw capable of movement relative to said first jaw and having a partially cylindrical recess; and a jaw insert pivotally inserted in said partially cylindrical recess and operatively coupled to a plurality of biasing members, said pivoting jaw insert having a generally flat surface and a partially cylindrical surface, said partially cylindrical surface of said jaw insert having a radius larger than the radius of said partially cylindrical recess.

2. The invention of claim 1 wherein the radius of said partial cylindrical surface of said jaw insert is greater than the radius of said partially cylindrical bearing surface.

3. The invention of claim 1 wherein said plurality of biasing members comprises a plurality of springs.

4. The invention of claim 1 wherein the radius of said partially cylindrical surface exceeds the radius of said partially cylindrical recess by about 0.007 inches.

5. A vise for clamping an angular workpiece comprising:

a pair of jaws capable of movement relative to each other, said first jaw having an external radius, said second jaw having a generally cylindrical recess; and a generally cylindrical jaw insert operable to be pivotally received in said cylindrical recess and operatively coupled to a plurality of biasing members, said jaw insert having a radius larger than the radius of said cylindrical recess, said jaw insert having a radius larger than the radius of said external radius.

6. The invention of claim 5 wherein said plurality of biasing members comprises a plurality of springs.

7. The invention of claim 5 wherein the radius of said generally cylindrical jaw insert exceeds the radius of said generally cylindrical recess by about 0.007 inches.

* * * * *